United States Patent [19]

Pfizenmaier et al.

[11] Patent Number: 4,742,320

[45] Date of Patent: May 3, 1988

[54] RESONATOR STRUCTURE COMPRISING METAL COATED TUBULAR CARRIER AND HAVING SLITS IN THE METAL COATING

[75] Inventors: Heinz Pfizenmaier, Leonberg; Franz Straus, Stuttgart; Ewald Schmidt, Ludwigsburg, all of Fed. Rep. of Germany

[73] Assignee: Robert Bosch GmbH, Stuttgart, Fed. Rep. of Germany

[21] Appl. No.: 843,798

[22] Filed: Mar. 26, 1986

Related U.S. Application Data

[63] Continuation of Ser. No. 706,043, Feb. 27, 1985, abandoned.

[30] Foreign Application Priority Data

Mar. 9, 1984 [DE] Fed. Rep. of Germany ..... 3408581

[51] Int. Cl.[4] ..... H01P 7/00

[52] U.S. Cl. ..... 333/219; 333/235

[58] Field of Search ..... 333/235, 219, 222, 223, 333/224, 202

[56] References Cited

U.S. PATENT DOCUMENTS

| | | | |
|---|---|---|---|
| 2,996,610 | 8/1961 | Relis | 333/235 X |
| 3,460,074 | 8/1969 | Kurzl et al. | 333/202 |
| 4,435,680 | 3/1984 | Francisz et al. | 333/219 X |
| 4,484,162 | 11/1984 | Kamada et al. | 333/202 X |

FOREIGN PATENT DOCUMENTS

| | | | |
|---|---|---|---|
| 1020250 | 2/1953 | France | 333/219 |
| 0039042 | 4/1978 | Japan | 333/235 |
| 0085101 | 6/1980 | Japan | 333/202 |
| 0036002 | 3/1983 | Japan | 333/202 |

*Primary Examiner*—Eugene R. Laroche
*Assistant Examiner*—Benny T. Lee
*Attorney, Agent, or Firm*—Frishauf, Holtz, Goodman & Woodward

[57] ABSTRACT

To improve the space factor of a barium titanate resonator, the resonator is a tubular carrier (11) having metal layers on the inner and outer surfaces. At least one of the metal layers is axially interrupted by a slit. Terminal connections for the resonator are located adjacent the slit on the interrupted layer, and on the continuous layer. For shielding, preferably, the continuous layers at the outside and end tabs (FIG. 4) may additionally be provided. More than one axially staggered inner/outer electrode layer system may be provided on one tubular carrier.

21 Claims, 1 Drawing Sheet

RESONATOR STRUCTURE COMPRISING METAL COATED TUBULAR CARRIER AND HAVING SLITS IN THE METAL COATING

This application is a continuation of application Ser. No. 706,043, filed Feb. 27, 1985, now abandoned.

The present invention relates to a resonator structure more particularly to a resonator structure having a substrate or carrier made of dielectric material on which metallic layers are applied.

BACKGROUND

Resonators using a substrate of dielectric material are known. See, for example, Kurt Rint, *Handbuch fur Hochfrequenz- und Elektro-Techniker,* Huthig-Verlag, Band V, 1981, (566 ff.). (Rint, *Handbook for High Frequency and Electrical Engineers,* publisher: Huthig, Volume 5, 1981, pages 566 et seq.). They are constructed in printed or strip conductor technology. Such resonators are made from a flat plate of dielectric material on which short circuited, or open circuited conductor elements are deposited. Resonators of this type require relatively large space.

THE INVENTION

It is an object to improve resonators, by so constructing the resonators that the space factor is substantially enhanced, that is, to make the resonators smaller without, however, loss of effectivness.

Briefly, the carrier of dielectric material is constructed in form of atubular structure, and first and second metal layers are applied, respectively, to the outer and inner surfaces of the tubular structure. At least one of the metal layers is formed with a slit extending in the direction which has a vectorial component extending in axial direction with respect to the tubular structure, and separating the respective metal layer. First and second connection means are connected to at least one of the metal layers in the region adjacent the slit, and a terminal is connected to the metal layer other than the one having the slit.

The arrangement has the advantage that the tubular, monolithic structure provides high mechanical stability and strength, long time steady state conditions of the electrical characteristics and that the quality of the resonator is high. It can readily be manufactured in large scale mass production permitting manufacture with readily reproducible characteristics of the resonator.

The resonator has the advantage that the resonant frequency thereof can be easily tuned by changing the width of the slit. This permits tuning of the resonator without decrease of its quality factor.

DRAWINGS

DETAILED DESCRIPTION

Figure 1:
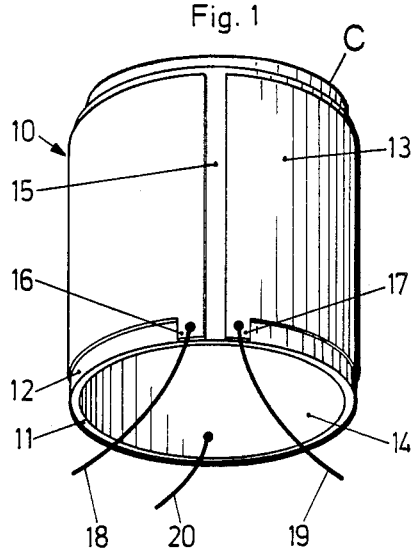
FIG. 1 is a perspective view of a basic resonator structure in accordance with the invention.

A resonator 10, see FIG. 1, has a tubular carrier of substrate 11 of dielectric material. The outer surface 12 has a metallic coating 13 thereon: the inner surface of a tubular structure 11 has a metallic coating or layer 14 thereon. The outer coating 13 is formed with a slit 15 extending in axial direction of the carrier 11. The portions of the metallic coating 13 adjacent the slit are extended into terminal surfaces 16, 17 for connecting conductors 18, 19. A connecting conductor 20 is secured to the inner metallic coating 14.

The tubular substrate or carrier 11 is made of dielectric material, preferably barium titanate. The metallic layers 13, 14 can be applied in any suitable manner, for example, by galvanizing, by vapor deposition of metal, by a printing process, by thick film technology, or in any other selected manufacturing process.

The dimension of the resonator is dependent on the dielectric constant of the carrier material, its diameter, the wall thickness of the tubular structure as well as the geometry of the outer metallic layer 13. The dimensioning is so carried out that the four-pole characteristics of the resonator are optimized, particularly with respect to phase and insertion damping.

Figure 2:
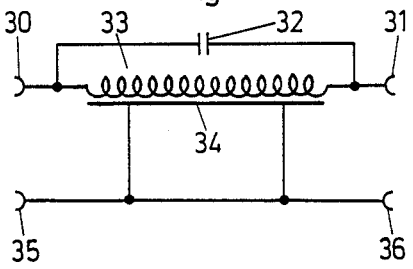
FIG. 2 is an equivalent circuit diagram of the resonator of FIG. 1.

FIG. 2 is the equivalent circuit diagram of the resonator of FIG. 1, in which the terminals 30, 31 correspond to the connecting tabs or surfaces 16, 17 the capacitor 32 and the coating 33 correspond to the outer metal layer 13 and the slit 15 therein. The conductor 34 is representative of the inner metallic layer 14, and the terminals 35, 36 correspond to the connecting conductor 20.

Various changes may be made; in an alternative construction of the resonator, the inner metallic layer 40 (FIG. 3) is formed with the longitudinal slit 41, whereas the outer surface 42 of the carrier is covered with a continuous metal coating 43. The relationship of slitted coating and continuous coating, with respect to FIG. 1, thus is reversed. The arrangement of FIG. 3 has the advantage that the stray field from the resonator are less than those of FIG. 1. The inner metallic layer 40 can be connected electrically similarly to the connection tabs 16, 17 (FIG. 1) or may be formed by through-conductive holes 44, 45 fitted in recesses 46, 47 removed from the outer metallic coating 43, and terminating at the outer surface 42 of the carrier.

Figure 4:
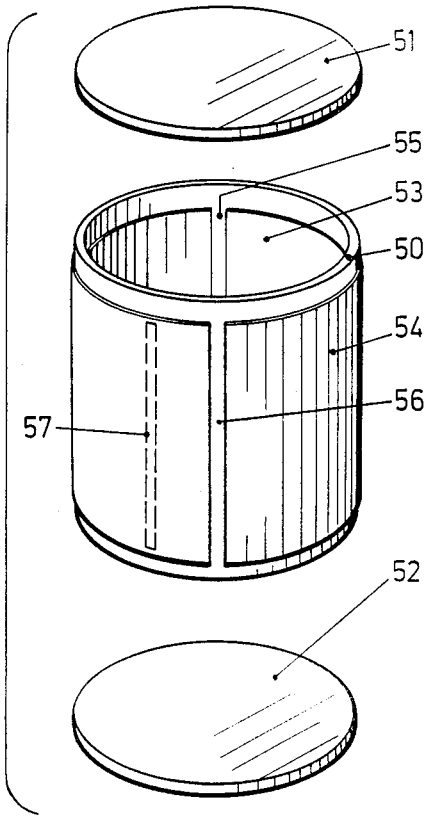
FIG. 4 is an exploded view of another resonator structure.

Shielding of the resonator can be further improved —see FIG. 4 —by utilizing a tubular carrier 50 which is closed off at the outer ends with shielding covers 51, 52. FIG. 4 also illustrates that, if desired, both the inner layer 53 as well as the outer layer 54 may be formed with a respective longitudinal slit 55, 56. In this arrangement it is desirable to so place the slits that the slits 55, 56 are diametrically opposite each other, i.e. a slit in one layer is opposite a continuous zone of the other layer.

Figure 5:
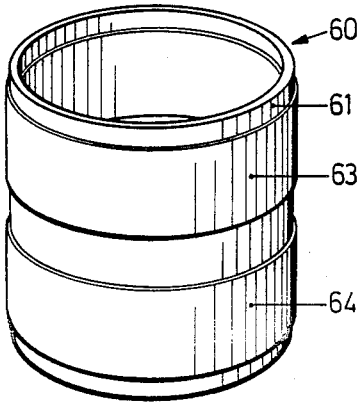
FIG. 5 is a perspective view of another embodiment of the resonator, formed as a double-resonator unit.

A dual resonator 60—see FIG. 5—utilizes a tubular carrier 61 with axially separated tubular metallic coatings or layers 63, 64. The inner side of the carrier 61 also has two separate metal coatings. Opposite inner and outer layers form a set. The arrangement of FIG. 5 can be extended axially, by placing more than two axially staggered metal layers, thus forming triple and multiple resonators, and hence a filter circuit.

Figure 3:
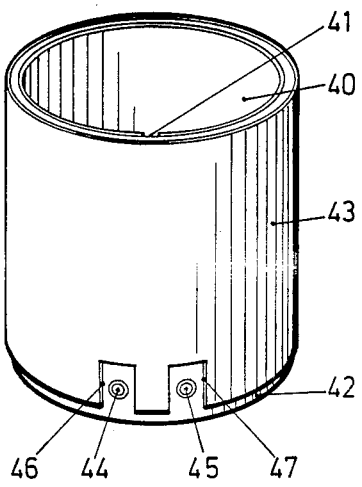
FIG. 3 is a perspective view of another embodiment of the resonator.

The resonators described are tuned by providing either additional slits in the inner, or outer metal layer, respectively; for example—see FIG. 4—an additional slit 57 may be provided. Since this is not a necessary feature, the slit 57, in the outer layer 54 is shown only in broken lines. Frequency tuning can also be done by changing the width of already present slits, for example, the width of the slit 15 (FIG. 1) or of the slit 4 (FIG. 3). A further possibility to change the frequency of the resonator is to introduce a fitting cylindrical of conductive tuning "core C" into the interior of the tubular carrier (FIG. 1).

For manufacture, it is desirable to fit two tubular carriers within each other, of which, for example, the inner carrier has the structure of FIG. 1 and the outer carrier the structure of FIG. 4. The resonators in accordance with the present invention can be readily assembled on printed circuit boards of radio apparatus in which, if desirable, the terminal connection tabs 16,17 (FIG. 1) can extend beyond the lower edge of the tubular carrier 11 to be fitted into corresponding slits in the printed circuit boards for soldering to conductors or conductive tracks thereon. Rather than using the conductor 20, a suitable connecting tab or surface may be provided. The connecting surfaces can also be placed on correspondingly formed projections extending from the tubular carrier 11 itself.

The longitudinal slits formed in the respective conductive layers or coatings 63, 64 and/or the inner conductive coatings in FIG. 5 have been omitted from FIG. 5 for clarity.

In FIG. 4, the cover plates 51,52 can be made of copper material and electrically connected to ground.

A typical diameter for the tubular structure 11 is 9.3 mm with an axial length of 10 mm. A suitable material for a tuninng core C is: copper.

A resonator having an inner diameter of 7.8 mm and a slit width of 0.2 mm has a response of resonant frequency of 489 MHz. Increasing the slit width by 0.7 mm changes the resonant frequency to 500 MHz.

We claim:

1. A microwave resonator structure comprising a tubular carrier structure (61) of solid dielectric material having a tube axis and defining an outer tubular surface of revolution about said axis, and an inner tubular surface of revolution about said axis;

a first metal coating layer (13) applied to the outer surface of said tubular carrier structure;

a second metal coating layer (14) applied on the inner surface of the tubular carrier structure, said first metal coating layer (13) and said second metal coating layer (14) being applied, respectively, only to the respective ones of said tubular surfaces, and said second metal coating layer being separate from said first metal coating layer, said first and second metal coating layers forming, in combination with the tubular carrier structure, a monolithic unit;

a slit (15) at least one having a direction component extending in the direction aligned with respect to the axis of the tubular carrier structure, formed in one of the metal coating layers and separating the respective metal coating layer to define a slit metal coating layer;

first and second connection means (16, 17) connected to the slit metal coating layer in regions adjacent the slit; and terminal means (20) connected to the metal coating layer other than said slit metal coating layer.

2. A resonator according to claim 1 including a core element (C) axially insertible into the tubular carrier structure for changing the resonant frequency of the resonator.

3. A resonator according to claim 1 wherein at least one of said metal coating layers is formed with a plurality of slits (15, 57).

4. A resonator according to claim 1 wherein the first metal coating layer is formed with said at least one slit.

5. A resonator according to claim 1 wherein the second metal coating layer (40) is formed with said at least one slit (41) and the first metal coating layer (43) is circumferentially continuous.

6. A resonator according to claim 1 wherein the tubular carrier structure defines axially open ends;

and further including a shielding cover (51, 52) applied to at least one of the open ends of the tubular carrier structure.

7. A resonator according to claim 1 wherein the tubular carrier structure comprises barium titanate.

8. A resonator according to claim 1 further including a connection arrangement for the second metal coating layer (40) comprising a zone of the first coating layer which is free of metal;

and at least one through-conductive opening in electircal communication with the second metal coating layer, said through-conductive opening being located in said zone free from metal of the first metal coating layer,

9. A resonator according to claim 1 wherein the at least one slit has a width which is selectable.

10. A microwave resonator structure comprising a tubular carrier structure (61) of solid dielectric material having a tube axis and defining an outer tubular surface of revolution about said axis and an inner tubular surface of revolution about said axis;

at least two axially spaced first metal coating layers (63, 64) applied to the outer surface of said carrier structure;

at least two second metal coating layers applied on the inner surface of said carrier structure, said at least two second metal coating layers being separate from said at least two first metal coating layers, said at least two second metal coating layers corresponding in number to said at least two first metal coating layers and being located in alignment with said at least two first coating layers and defining with the corresponding first coating layer a set of layers;

a first and second coating layers forming, in combination with the tubular carrier structure, a monolithic unit, wherein one of the metal coating layers of each of the set of layers is formed with at least one slit (15) having a direction component extending in the direction aligned with respect to the axis of the tubular carrier structure and separating the respective layers to define at least two slit metal coating layers;

first and second connection means (16, 17) connected to the at least two slit metal coating layers in regions adjacent the slits;

and terminal means (20) connected to at least two metal coating layers other than said slit metal coating layers.

11. A resonator according to claim 10 including a core element (C) axially insertible into the tubular carrier structure for changing the resonant frequency of the resonantor.

12. A resonator according to claim 10 wherein said slit metal coating layers are formed with a plurality of slits.

13. A resonator according to claim 10 wherein the first metal coating layers are formed with said at least one slit.

14. A resonator according to claim 10 wherein the second metal coating layers (40) are formed with said at least one slit (41) and the outer metal coating layers (43) are circumferentially continuous.

15. A resonator according to claim 10 wherein the tubular carrier structure comprises barium titanate.

16. A resonator according to claim 10 further including a connection arrangement for the second metal coating layers (40) comprising zones of the first coating layers which are free of metal;

and through-conductive opening in electrical communication with the respective second metal coating layers, said through-conductive openings being located in said zones free from metal of the first metal coating layers.

17. A resonator according to claim 10 wherein the first metal coating layers and the second metal coating layers are applied, respectively, only to the respective ones of said tubular surfaces.

18. A resonator according to claim 10 wherein the slit has a width which is selectable.

19. A method of tuning the resonator as claimed in claim 1 comprising selecting the width of the slits.

20. A method of tuning the resonator as claimed in claim 10 comprising selecting the width of the slits.

21. A microwave resonator structure comprising a tubular carrier structure (61) of solid dielectric material having a tube axis and defining an outer tubular surface of revolution about said axis, and an inner tubular surface of revolution about said axis;

a first metal coating layer (13) applied to the outer surface of said tubular carrier structure;

a second metal coating layer (14) applied on the inner surface of the tubular carrier structure, said first and second metal layer coating layers forming, in combination with the tubular carrier structure, a monolithic unit;

at least one slit (15) having a direction component extending in the direction aligned with respect to the axis of the tubular carrier structure formed in each of the first and second metal coating layers and separating the circumferential continuity of said metal coating layers, said slits in said first and second metal coating layers being respectively circumferentially positioned such that a slit in one of said metal coating layers is located opposite a circumferentially continuous portion of the other of said layers.

* * * * *